US009789526B2

(12) United States Patent
Kozaki et al.

(10) Patent No.: US 9,789,526 B2
(45) Date of Patent: Oct. 17, 2017

(54) PLATE-LIKE-WORKPIECE TWISTING AND RETAINING APPARATUS, PLATE-LIKE-WORKPIECE TWISTING AND RETAINING METHOD, AND PLATE-LIKE-WORKPIECE TWISTING AND SHAPING METHOD

(71) Applicant: MITSUBISHI HEAVY INDUSTRIES, LTD., Tokyo (JP)

(72) Inventors: Takashi Kozaki, Tokyo (JP); Noriaki Fukami, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/894,269

(22) PCT Filed: Jun. 6, 2014

(86) PCT No.: PCT/JP2014/065145
§ 371 (c)(1),
(2) Date: Nov. 25, 2015

(87) PCT Pub. No.: WO2014/199928
PCT Pub. Date: Dec. 18, 2014

(65) Prior Publication Data

US 2016/0114370 A1 Apr. 28, 2016

(30) Foreign Application Priority Data

Jun. 12, 2013 (JP) ..... 2013-123712

(51) Int. Cl.
*B21D 11/14* (2006.01)
*B21D 31/06* (2006.01)
(Continued)

(52) U.S. Cl.
CPC ..... *B21D 5/0209* (2013.01); *B21D 11/14* (2013.01); *B21D 31/06* (2013.01); *B21D 43/003* (2013.01)

(58) Field of Classification Search
CPC ..... B21D 37/02; B21D 31/06; B21D 5/0209; B21D 43/003; B21D 3/12; B21D 11/14
(Continued)

(56) References Cited

U.S. PATENT DOCUMENTS 4,091,938 A 5/1978 Trolle
4,212,188 A 7/1980 Pinson
(Continued)

FOREIGN PATENT DOCUMENTS

CN 2902505 Y 5/2007
CN 202174142 U 3/2012
(Continued)

OTHER PUBLICATIONS

PCT, "International Search Report for International Application No. PCT/JP2014/065145".
(Continued)

*Primary Examiner* — David Bryant
*Assistant Examiner* — Pradeep C Battula
(74) *Attorney, Agent, or Firm* — Manabu Kanesaka; Benjamin Hauptman; Kenneth Berner

(57) ABSTRACT

Provided are a highly-versatile plate-like-workpiece twisting and retaining apparatus, plate-like-workpiece twisting and retaining method, and plate-like-workpiece twisting and shaping method that can give a freely-chosen twisted shape or curved shape to a plate-like workpiece with a simple, highly-versatile configuration without having to prepare a die member and that can also be applied to an integral skin. A twisting and retaining apparatus includes at least two support points that are contactable with a first surface in a
(Continued)

twisting range of a plate-like workpiece; a plurality of pressing points that are similarly contactable with a second surface in the twisting range and that flank a line connecting the at least two support points in plan view of the plate-like workpiece; and an advance-retract driving apparatus (support unit, pressing unit) that causes at least the support points or the pressing points to advance and retract in a thickness direction of the plate-like workpiece.

9 Claims, 7 Drawing Sheets

(51) Int. Cl.
*B21D 5/02* (2006.01)
*B21D 43/00* (2006.01)

(58) Field of Classification Search
USPC ..... 72/413, 371, 310, 299
See application file for complete search history.

(56) References Cited

U.S. PATENT DOCUMENTS

| | | | | |
|---|---|---|---|---|
| 4,329,862 | A | 5/1982 | Harburn et al. | |
| 4,802,357 | A * | 2/1989 | Jones | B21D 5/02 700/165 |
| 5,063,662 | A * | 11/1991 | Porter | B21D 11/14 148/671 |
| 5,072,606 | A | 12/1991 | Koehler et al. | |
| 6,209,380 | B1 * | 4/2001 | Papazian | B21D 37/02 72/413 |
| 6,938,448 | B2 * | 9/2005 | Kennerknecht | B21D 11/08 29/90.7 |
| 7,891,075 | B2 * | 2/2011 | Mankame | B23Q 3/086 72/342.1 |
| 8,298,242 | B2 * | 10/2012 | Justis | A61B 17/8863 72/413 |
| 9,010,166 | B2 * | 4/2015 | Brennand | B21D 22/02 72/299 |
| 2014/0366600 | A1 * | 12/2014 | Kozaki | B21D 5/0209 72/20.3 |

FOREIGN PATENT DOCUMENTS

| | | | | |
|---|---|---|---|---|
| CN | 202192139 | U | 4/2012 | |
| CN | 202278036 | U | 6/2012 | |
| EP | 0500458 | A1 | 8/1992 | |
| EP | 1739195 | A1 * | 1/2007 | C21D 10/005 |
| EP | 2789410 | A1 | 10/2014 | |
| FR | 2257364 | A1 | 8/1975 | |
| JP | S56-146672 | A | 11/1981 | |
| JP | H1-177027 | U | 12/1989 | |
| JP | H04-046643 | A | 2/1992 | |
| JP | H06-226365 | A | 8/1994 | |
| JP | 2000-301248 | A | 10/2000 | |
| JP | 3740103 | B2 | 2/2006 | |
| JP | 3869783 | B | 1/2007 | |
| JP | 2013-116492 | A | 6/2013 | |

OTHER PUBLICATIONS

PCT, "Written Opinion of the International Searching Authority for International Application No. PCT/JP2014/065145".
China Patent Office, "Office Action for Chinese Patent Application No. 201480029970.2," Jul. 26, 2016.
Europe Patent Office, "Search Report for European Patent Application No. 14810895.4," dated Mar. 20, 2017.

* cited by examiner

PLATE-LIKE-WORKPIECE TWISTING AND RETAINING APPARATUS, PLATE-LIKE-WORKPIECE TWISTING AND RETAINING METHOD, AND PLATE-LIKE-WORKPIECE TWISTING AND SHAPING METHOD

RELATED APPLICATIONS

The present application is National Phase of International Application No. PCT/JP2014/065145 filed Jun. 6, 2014, and claims priority from Japanese Application No. 2013-123712, filed Jun. 12, 2013, the disclosure of which is hereby incorporated by reference herein in its entirety.

TECHNICAL FIELD

The present invention relates to a plate-like-workpiece twisting and retaining apparatus, a plate-like-workpiece twisting and retaining method, and a plate-like-workpiece twisting and shaping method for retaining a plate-like workpiece in a twisted state and performing a process, such as peen forming, thereon.

BACKGROUND ART

When processing a metallic sheet having a large area and a complicated curved surface, such as an aircraft wing, a processing method called peen forming or shot peen forming has been widely used in recent years. As disclosed in, for example, Patent Literatures 1 and 2, this processing method involves retaining a metallic plate-like workpiece and blasting the plate-like workpiece with steel particles called shot having a diameter of about 0.5 mm to 4 mm at high speed so as to make the steel particles collide therewith with large momentum, thereby generating plastic strain in the plate-like workpiece and curving and shaping the plate-like workpiece into a desired shape.

When performing such peen forming, it is known that, by blasting the plate-like workpiece with shot after preliminarily twisting the plate-like workpiece within its elastically deformable range or after curving and retaining the plate-like workpiece, elastic stress applied to the plate-like workpiece accelerates deformation of the plate-like workpiece and thus significantly enhances the shapeability thereof. This technique is called stress peen forming. When performing this stress peen forming, the plate-like workpiece is elastically deformed by forcedly making the plate-like workpiece conform to a press jig and securing the plate-like workpiece with a securing tool, as disclosed in FIG. 8(b) of Patent Literature 2.

Furthermore, without the use of a press jig, a plate-like workpiece is retained in a twisted or curved shape by using a clamping-type retaining apparatus or a retaining apparatus that employs a hydraulic jack. In this case, in order to apply stress that gives the peened plate-like workpiece a curvature the same as or close to that of the completed shape thereof by using the aforementioned retaining apparatus, a template (i.e., an R-shaped template) having a predetermined curvature that is set in view of spring-back is pressed against the curved surface of the plate-like workpiece while checking the curvature thereof so as to set it to the predetermined curvature.

CITATION LIST

Patent Literature

{PTL 1}
The Publication of Japanese Patent No. 3740103
{PTL 2}
The Publication of Japanese Patent No. 3869783

SUMMARY OF INVENTION

Technical Problem

However, in the method of elastically deforming a plate-like workpiece by using a press jig, a huge press jig is necessary to deal with curvature that changes in a complicated manner in the longitudinal direction, as in the main wing of an aircraft. In addition, since several kinds of these huge press jigs have to be prepared in correspondence with multiple models and areas, this is problematic in that not only is the manufacturing of such press jigs costly, but also a large space is necessary for storing such press jigs.

On the other hand, in the method of retaining a plate-like workpiece in a twisted shape or curved shape by using a clamping-type retaining apparatus or a retaining apparatus that employs a hydraulic jack without the use of a press jig, for example, the stroke adjustment of the retaining apparatus and the management of the twisted shape and the curved shape using the template are dependent on the skills of the operator. This is problematic in terms of reproducibility of the shape of the processed plate-like workpiece, that is, product consistency.

Furthermore, with regard to recent aircraft wings, integral skins, which are obtained by combining outer plates called skins with rib-like reinforcement members called stringers provided within the outer plates, are widely used. If processing such an integral skin into a twisted shape or a curved shape by the stress peen forming described above, it is difficult to use a die member, such as a jig or a template for giving the integral skin a twisted or curved shape, without causing the die member to interfere with the stringers.

The present invention has been made in view of the aforementioned problems, and an object thereof is to provide a highly-versatile plate-like-workpiece twisting and retaining apparatus, plate-like-workpiece twisting and retaining method, and plate-like-workpiece twisting and shaping method that can give a freely-chosen twisted shape or curved shape to a plate-like workpiece with a simple, highly-versatile configuration without using a die member and that can also be applied to an integral skin.

Solution to Problem

In order to solve the aforementioned problems, the present invention employs the following solutions.

A plate-like-workpiece twisting and retaining apparatus according to a first aspect of the present invention is for retaining a plate-like workpiece while twisting the plate-like workpiece within an elastically deformable range thereof and includes at least two support points that are contactable with a first surface of the plate-like workpiece; at least two pressing points that are similarly contactable with a second surface of the plate-like workpiece and that flank a line connecting the at least two support points; and an advance-retract driving means that causes at least one of the support points and the pressing points to advance and retract in a thickness direction of the plate-like workpiece.

According to the above-described configuration, the at least two support points are brought into contact with the first surface of the plate-like workpiece, the at least two pressing points are similarly brought into contact with the second surface of the plate-like workpiece such that the at least two pressing points flank the line connecting the at least two support points, and the advance-retract driving means presses at least one of the support points and the pressing points in the thickness direction of the plate-like workpiece, so that the plate-like workpiece becomes twisted and deformed. The amount of deformation (i.e., the twisting amount) in this case can be arbitrarily set in accordance with, for example, the number of support points and the number of pressing points, the relative position between the support points and the pressing points in the planar direction of the plate-like workpiece, and the pressing amount of the support points or the pressing points.

Therefore, the plate-like workpiece can be twisted with a simple, highly-versatile configuration without having to prepare a die member, such as a press jig or a template, as in the related art. In addition, the support points and the pressing points come into point contact with the plate-like workpiece. Thus, even an integral skin obtained by combining an outer plate (skin) with rib-like reinforcement members (stringers), as in an aircraft wing, can be readily twisted by bringing the support points or the pressing points into contact with areas other than the reinforcement members.

In the above-described configuration, at least one of the support points and the pressing points is independently movable in a planar direction of the plate-like workpiece.

In the case of the above-described configuration, for example, by positionally moving any of the support points and the pressing points in the planar direction of the plate-like workpiece, the twisted shape and the torsional curvature of the plate-like workpiece can be set freely.

In addition, in the case where multiple support points and multiple pressing points are provided and are all movable in the planar direction of the plate-like workpiece, complex curved surfaces can be readily dealt with. Moreover, the number of support points and the number of pressing points that are to be brought into contact with the plate-like workpiece can be adjusted to numerical values suitable for the size of the plate-like workpiece.

In the above-described configuration, the advance-retract driving means is provided so as to be capable of causing all of the support points and the pressing points to independently advance and retract.

According to the above-described configuration, the advance-retract positions (i.e., protruding amounts) of multiple support points and multiple pressing points relative to the plate-like workpiece can be varied. Consequently, the plate-like workpiece can be retained in a complicated twisted shape.

In the above-described configuration, the support points include three or more support points and the pressing points include three or more pressing points, and at least one of the three or more support points and the three or more pressing points is contactable with a location other than contact positions of the two support points and the two pressing points necessary for twisting the plate-like workpiece.

According to the above-described configuration, while twisting the plate-like workpiece by pressing the two support points and the two pressing points onto the first surface and the second surface of the plate-like workpiece, as described above, another support point or pressing point can be simultaneously pressed onto a location other than the contact positions of the two support points and the two pressing points necessary for twisting the plate-like workpiece. For example, the other support point or pressing point may be pressed onto, for example, an intermediate section of the plate-like workpiece, thereby bending the plate-like workpiece while twisting it or preventing an intermediate section of the plate-like workpiece from sagging downward.

In the above-described configuration, the plate-like-workpiece twisting and retaining apparatus further includes an advance-retract-position detecting means that detects an advance-retract position of each of the support points and the pressing points; and a control means that receives advance-retract-position data from the advance-retract-position detecting means and drives the advance-retract driving means so that the support points and the pressing points are set at predetermined advance-retract positions.

According to the above-described configuration, control can be performed so that the relative distances between the support points and the pressing points are set to appropriate values, whereby the plate-like workpiece can be given an accurate twisted shape.

In the above-described configuration, the plate-like-workpiece twisting and retaining apparatus further includes a load detecting means that detects loads applied to the pressing points; and a control means that receives load data from the load detecting means and drives the advance-retract driving means so that predetermined loads are applied.

For example, if the plate-like workpiece is to undergo a peen forming process while being twisted and retained and is to be plastically deformed such that the plate-like workpiece is maintained in a twisted shape, the above-described configuration can give the plate-like workpiece an accurate twisted shape by using a simple configuration. Specifically, regardless of the relative relationship between the height of the plate-like workpiece before twisting and deforming and the height of the support points, the support points only need to be given a function for stopping at that height and maintaining that position when coming into contact with the plate-like workpiece. Then, the pressing points alone are moved toward the plate-like workpiece while the loads applied onto the pressing points are detected with the load detecting means, whereby the plate-like workpiece can be twisted and deformed.

In the above-described configuration, when peen forming is to be performed while twisting the plate-like workpiece, the control means performs control to stop the peen forming when the load data received from the load detecting means stop decreasing or reach predetermined load values.

In the case of the above-described configuration, a reaction force that causes the plate-like workpiece to recover its flat shape decreases as the peen forming process performed on the twisted and retained plate-like workpiece proceeds, and the load data input to the control means from the load detecting means decrease. Thus, it can be determined that the twisting process of the plate-like workpiece is completed when the load data stop decreasing or reach predetermined load values, so that the peen forming process can be terminated. Therefore, the time spent for the peen forming process can be minimized, thereby shortening the processing time, as well as saving labor.

A plate-like-workpiece twisting and retaining method according to a second aspect of the present invention is for retaining a plate-like workpiece while twisting the plate-like workpiece within an elastically deformable range thereof and includes bringing at least two support points into contact with a first surface of the plate-like workpiece; bringing at least two pressing points into contact with a second surface of the plate-like workpiece such that the at least two pressing points flank a line connecting the at least two support points; and twisting and retaining the plate-like workpiece by pressing at least one of the support points and the pressing points in a thickness direction of the plate-like workpiece.

According to the above-described method, the at least two support points are brought into contact with the first surface of the plate-like workpiece, the at least two pressing points are similarly brought into contact with the second surface of the plate-like workpiece such that the at least two pressing points flank the line connecting the at least two support points, and at least one of the support points and the pressing points is pressed in the thickness direction of the plate-like workpiece, so that the plate-like workpiece becomes twisted and deformed. The amount of deformation (i.e., the twisting amount) in this case can be arbitrarily set in accordance with, for example, the relative position between the support points and the pressing points in the planar direction of the plate-like workpiece and the pressing amount of the support points or the pressing points.

A plate-like-workpiece twisting and shaping method according to a third aspect of the present invention includes twisting and shaping a plate-like workpiece by performing peen forming from at least one surface of the plate-like workpiece while retaining the plate-like workpiece in a twisted state by using the aforementioned plate-like-workpiece twisting and retaining apparatus.

According to the above-described method, the plate-like workpiece is preliminarily twisted and retained within its elastically deformable range by the twisting and retaining apparatus, and the peen forming is performed in this state, so that elastic stress applied to the plate-like workpiece accelerates the deformation of the plate-like workpiece, thereby significantly enhancing the processability of the plate-like workpiece.

Advantageous Effects of Invention

Accordingly, with the plate-like-workpiece twisting and retaining apparatus, the plate-like-workpiece twisting and retaining method, and the plate-like-workpiece twisting and shaping method according to the present invention, a plate-like workpiece can be given a freely-chosen twisted shape or curved shape with a simple, highly-versatile configuration without using a die member. In particular, the present invention is suitable for retaining an integral skin used in an aircraft wing, which is obtained by combining an outer plate (skin) with reinforcement members (stringers), in a twisted shape.

DESCRIPTION OF EMBODIMENT

An embodiment of the present invention will be described below with reference to FIGS. 1 to 8.

Figure 5:
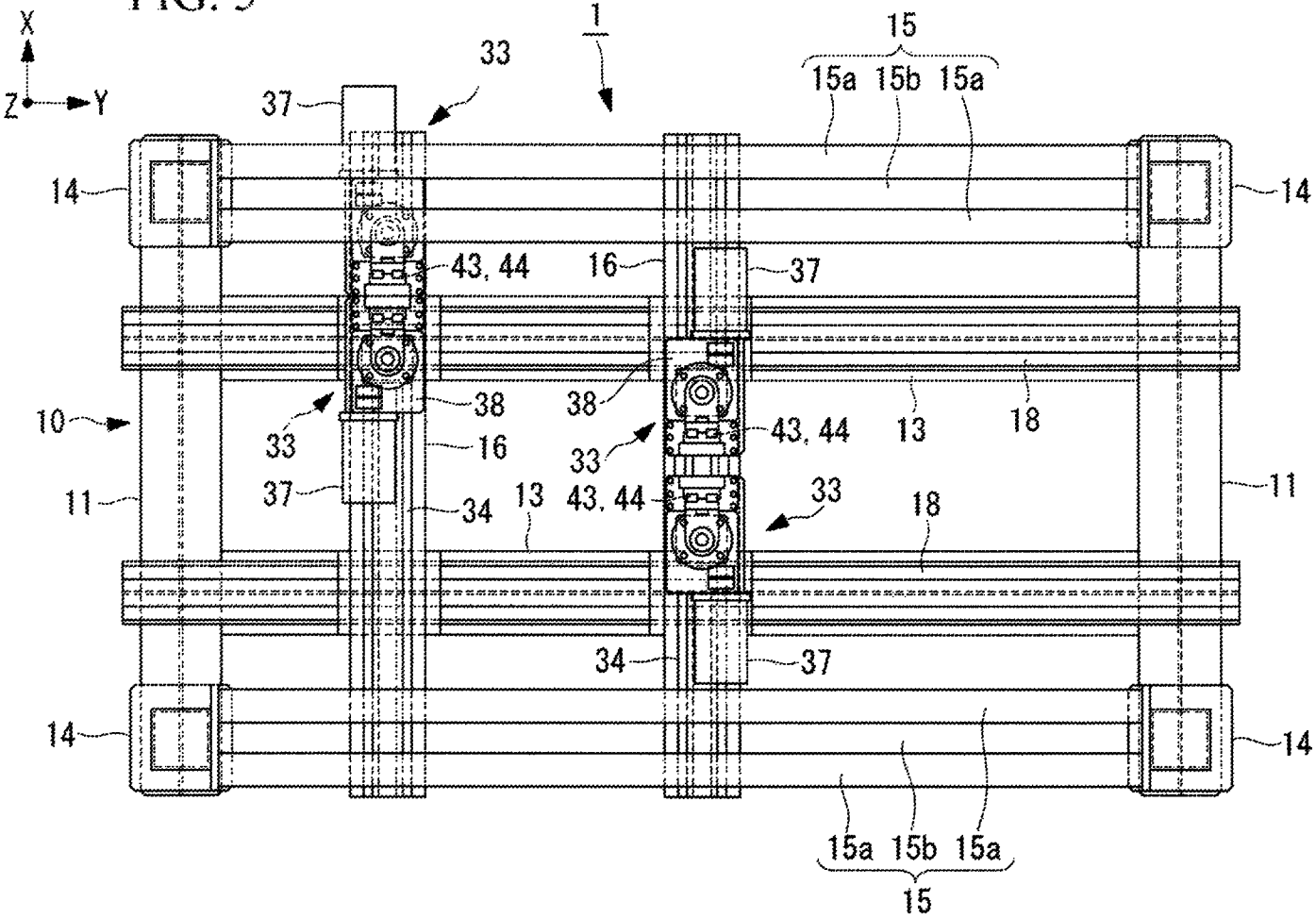
FIG. 5 is a plan view as viewed along an arrow V in FIG. 4.

A twisting and retaining apparatus 1 according to this embodiment is rectangular in plan view (see FIG. 5). For the sake of convenience, the direction extending along a first edge (widthwise direction) of the twisting and retaining apparatus 1 will be referred to as an X-axis direction, the direction extending along a second edge (lengthwise direction) will be referred to as a Y-axis direction, and the height direction will be referred to as a Z-axis direction.

Figure 1:
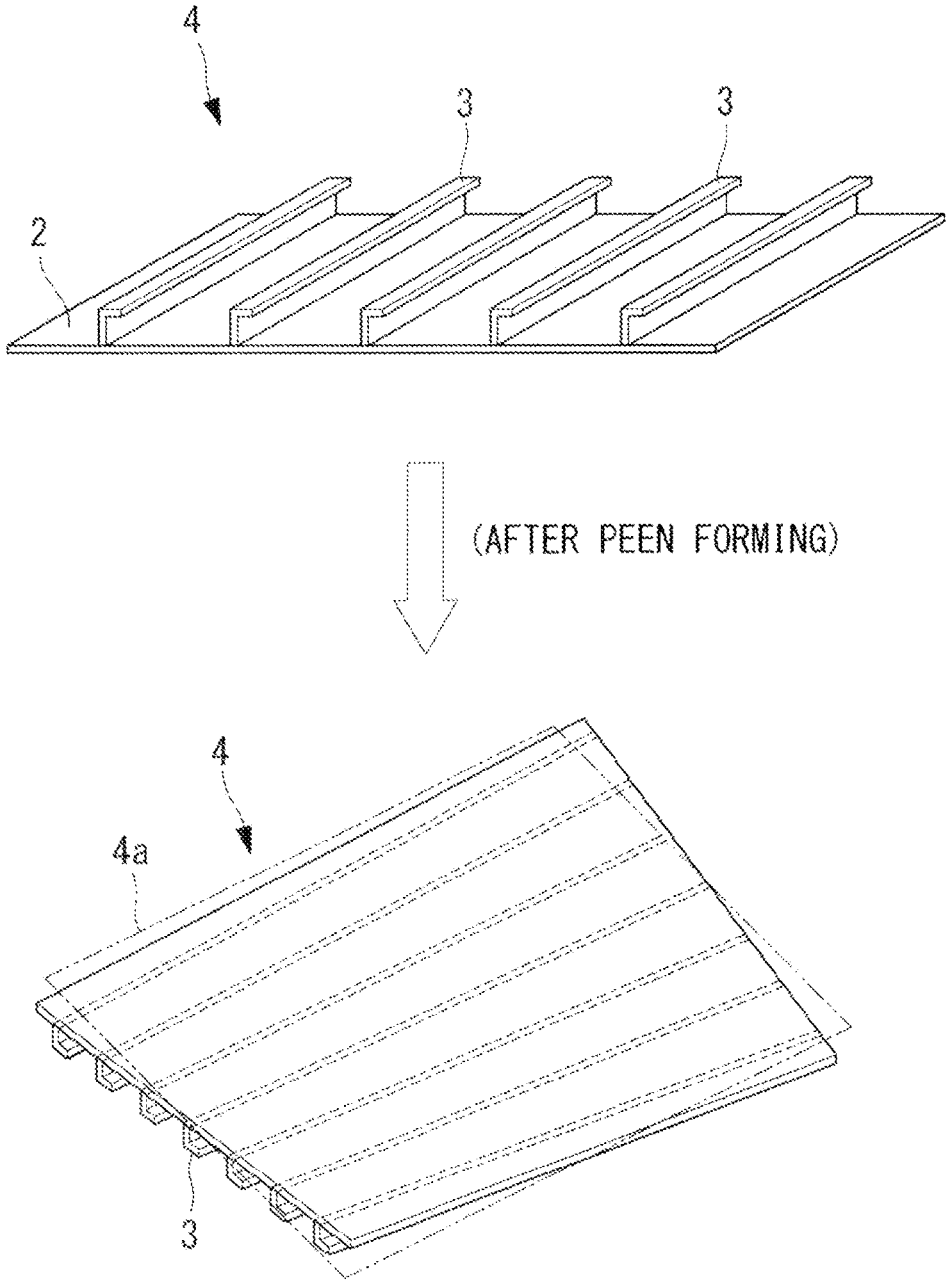
FIG. 1 is a perspective view illustrating an example in which an aircraft integral skin is processed into a twisted shape by peen forming.

For example, as shown in FIG. 1, the twisting and retaining apparatus 1 is a pre-stressing and retaining apparatus that preliminarily deforms and retains an aircraft integral skin 4, which is obtained by combining an aluminum-alloy outer plate 2 called a skin with rib-like reinforcement members 3 called stringers, within its elastically deformable range from a non-deformed flat state 4*a* when deforming the integral skin 4 into, for example, a twisted shape or curved shape by stress peen forming.

As an alternative to the integral skin 4, a normal flat metallic plate may be curved and retained. The following description will be directed to a case where a flat plate-like workpiece W is to be curved and retained.

Figure 2:
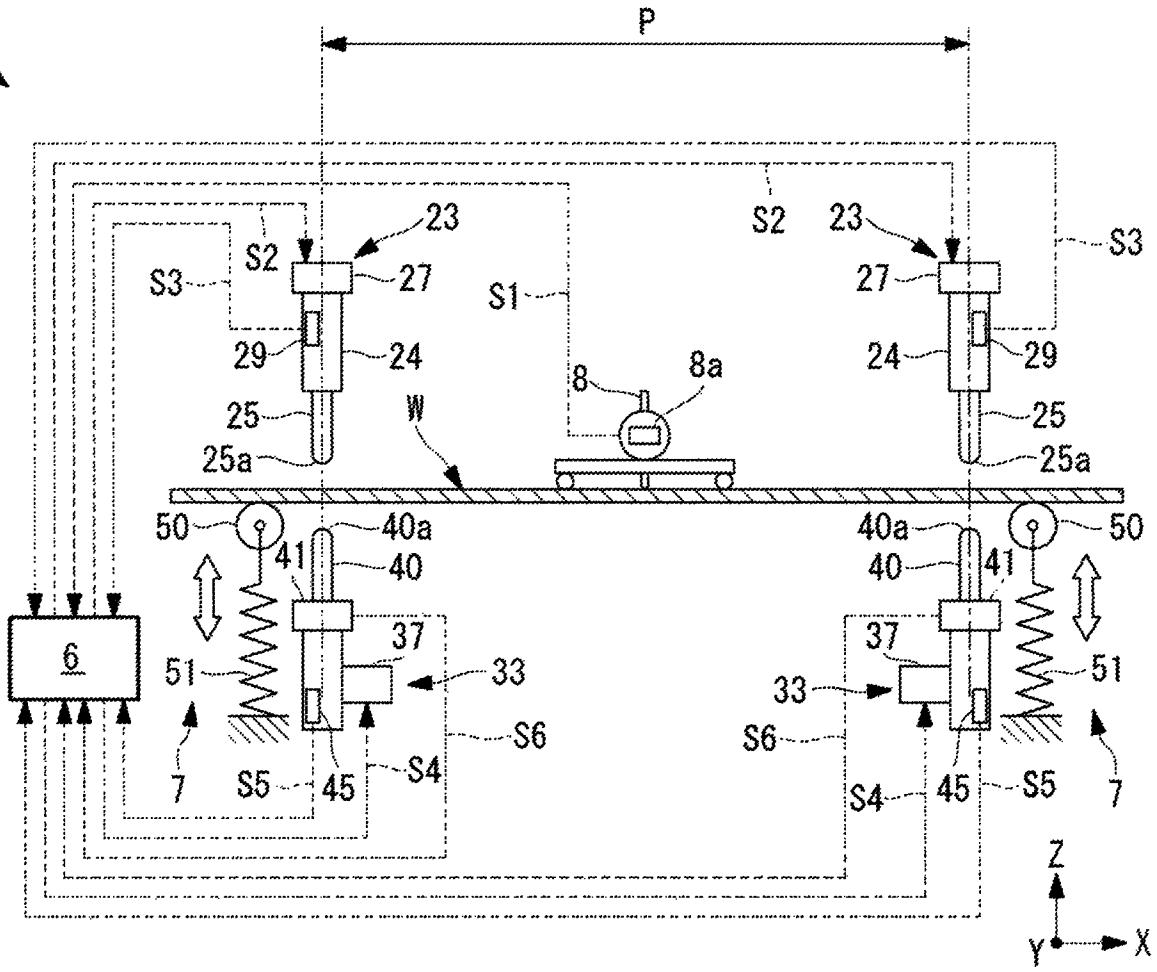
FIG. 2 schematically illustrates the basic configuration of a twisting and retaining apparatus according to the present invention.
Figure 3:
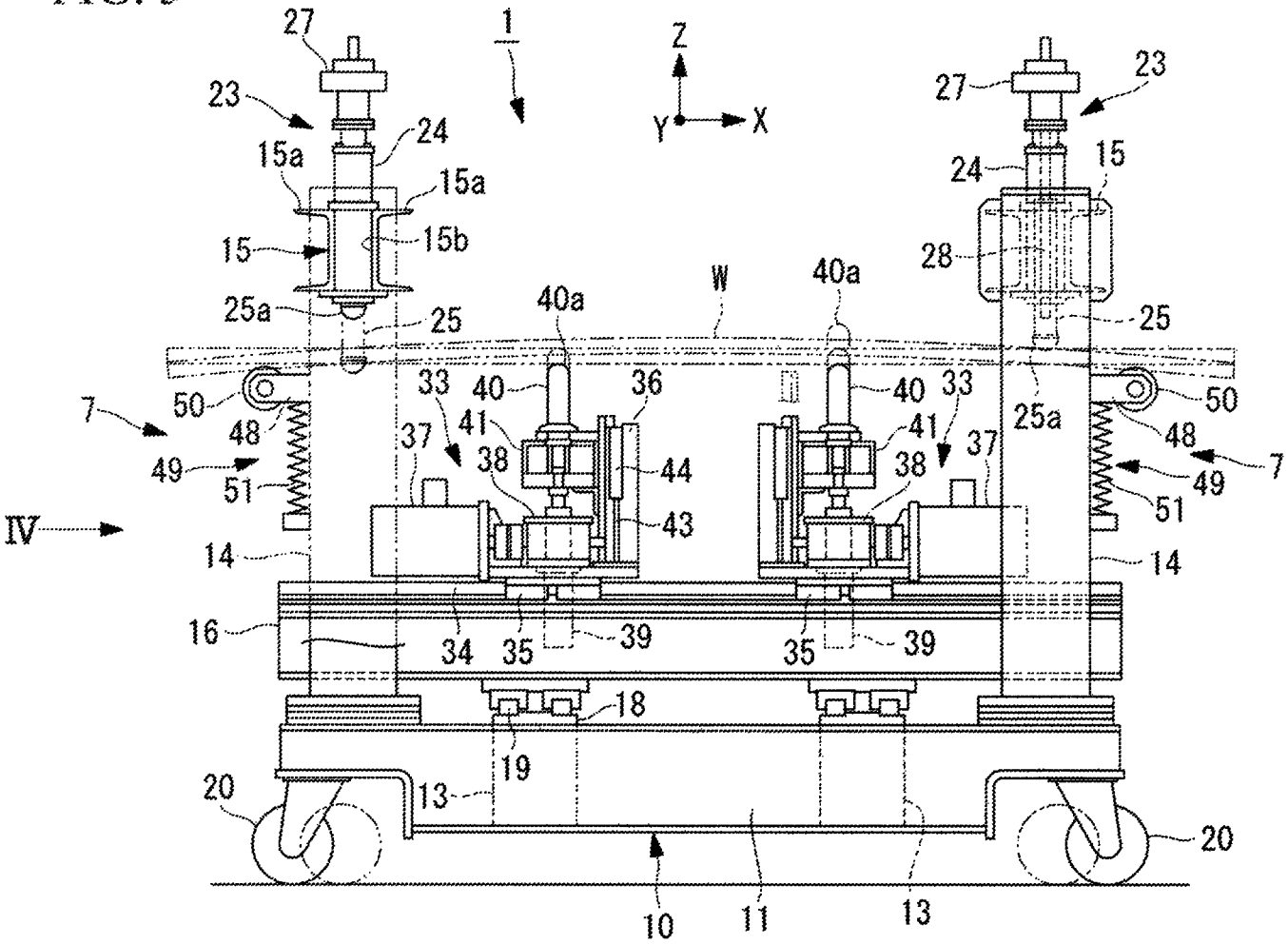
FIG. 3 is a front view illustrating a specific example of the twisting and retaining apparatus according to the present invention.
Figure 4:
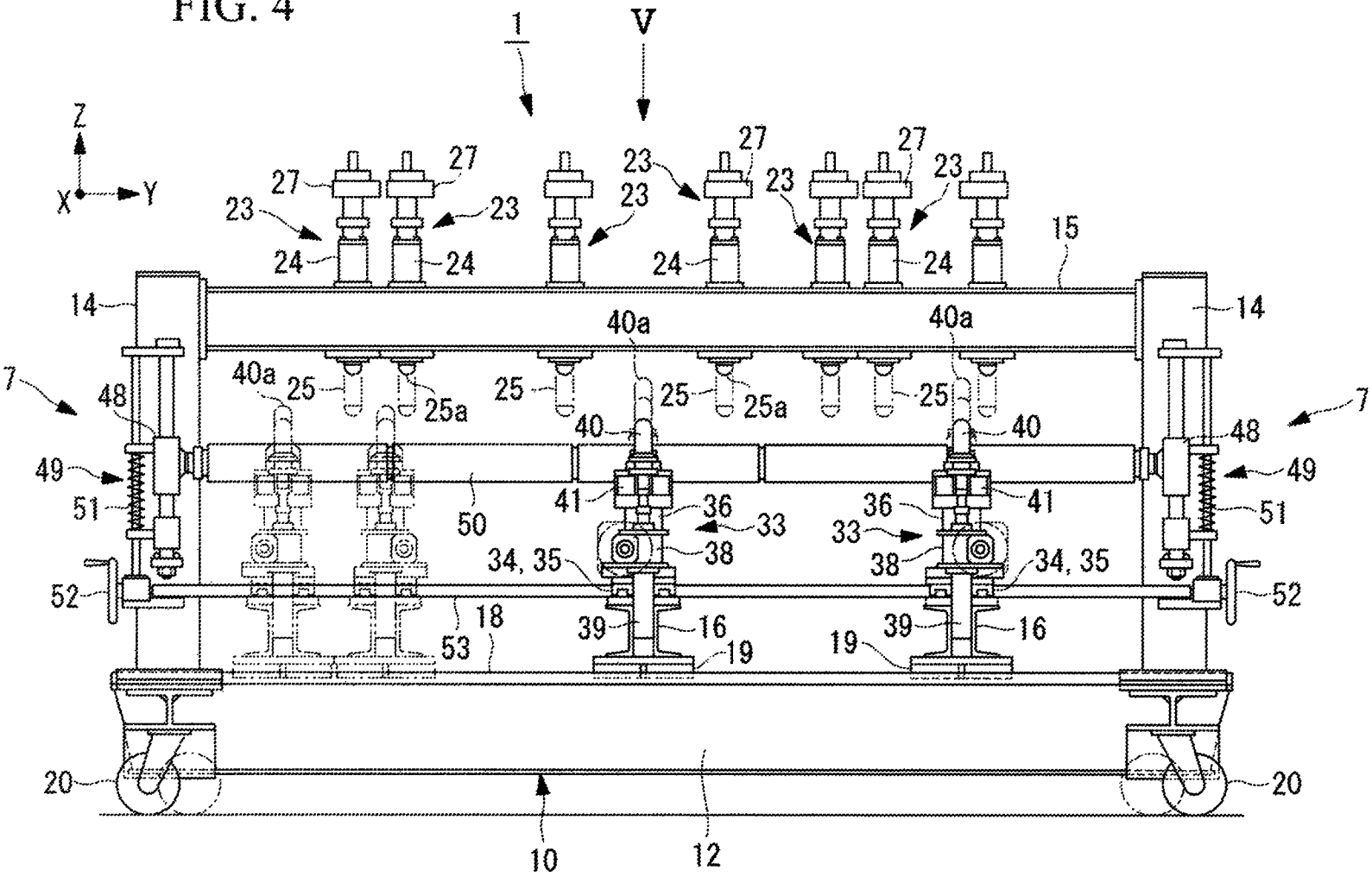
FIG. 4 is a side view as viewed along an arrow IV in FIG. 3.

FIG. 2 schematically illustrates the basic configuration of the twisting and retaining apparatus 1. FIGS. 3 to 5 are a front view, a side view, and a plan view, respectively, illustrating a specific example of the twisting and retaining apparatus 1. When viewed in the Y-axis direction (see FIGS. 2 and 3), the twisting and retaining apparatus 1 includes at least two support points 25*a* that are contactable with diagonal positions on a first surface (e.g., the upper surface) within a twisting range P of the plate-like workpiece W, which is horizontally set, and at least two pressing points 40*a* that are similarly contactable with diagonal positions located on a second surface (e.g., the lower surface) within the twisting range P and not facing the support points 25*a*.

Although two support points 25*a* and two pressing points 40*a* are provided when viewed in the Y-axis direction in FIG. 3, there are multiple support points 25*a* and multiple pressing points 40*a* arranged in the Y-axis direction when viewed in the X-axis direction in FIG. 4. In this embodiment, for example, there are seven support points 25*a* arranged in the Y-axis direction, so that a total of 14 support points 25*a* are provided. Moreover, for example, there are two pressing points 40*a* arranged in the Y-axis direction, so that a total of four support points 25*a* are provided.

Furthermore, as shown in FIG. 2, the twisting and retaining apparatus 1 includes a control unit 6 (control means), reaction-force absorbing devices 7, and a curvature measuring device 8. The curvature measuring device 8 is installed so as to be provided at, for example, the upper surface of the plate-like workpiece W and measures and detects the curvature of the plate-like workpiece W when the plate-like workpiece W is curved. The curvature data is displayed on a display section 8*a* and is also input to the control unit 6 via a control line S1.

The twisting and retaining apparatus 1 has a base frame 10 that is rectangular in plan view and that is constituted of two beam-like transverse frame members 11 extending parallel to the X-axis direction and two beam-like longitudinal frame members 12 extending parallel to the Y-axis direction, and two lower crossbeams 13 extending in the Y-axis direction are bridged between the opposing transverse frame members 11. Furthermore, support columns 14 extend in the Z-axis direction from the four corners of the base frame 10, and the upper ends of the support columns 14 arranged in the Y-axis direction are connected by two upper crossbeams 15 extending in the Y-axis direction. Moreover, two movable beams 16 extending in the X-axis direction are placed on the lower crossbeams 13. The movable beams 16 can be moved smoothly in the Y-axis direction via guide rails 18 and linear bearings 19 provided on the upper surfaces of the lower crossbeams 13. The lower surfaces of the four corners of the base frame 10 are provided with brake-equipped casters 20 for moving and anchoring purposes.

As shown in FIG. 3, each upper crossbeam 15 has two channel members 15*a* disposed in a back-to-back fashion with a distance therebetween so that a slit 15*b* with a fixed width is formed therebetween. The slit 15*b* has a plurality of (six in this case) support units 23 (advance-retract driving means) arranged therein. Each support unit 23 has an expandable-contractible cylinder structure having a cylinder 24 whose axis extends in the Z-axis direction, and a support rod 25 advances downward from the cylinder 24. The distal end of this support rod 25 serves as the aforementioned support point 25*a*. The support units 23 are movable in the Y-axis direction along the upper crossbeams 15 (slits 15*b*) and can be secured at arbitrary positions in accordance with pressing areas of the plate-like workpiece W. The support units 23 may be moved manually or may be moved by a driving mechanism (not shown).

The upper end of the cylinder 24 in each support unit 23 is provided with a servomotor 27 that functions as an actuator. The power (rotational force) of the servomotor 27 is transmitted to the support rod 25 (support point 25*a*) via a ball screw mechanism 28 (see FIG. 3) so as to cause the support point 25*a* to advance and retract. As shown in FIG. 2, the servomotor 27 is connected to the control unit 6 via a control line S2 so as to be controlled by the control unit 6.

Furthermore, the cylinder 24 in each support unit 23 has disposed therein a linear scale 29 (advance-retract-position detecting means) that detects the position of the support point 25*a* in the Z-axis direction (i.e., the advance-retract position of the support rod 25). The linear scale 29 is connected to the control unit 6 via a control line S3, and the advance-retract-position data of the support point 25*a* detected by the linear scale 29 is input to the control unit 6.

Two pressing units 33 (advance-retract driving means) are disposed on the upper surface of each of the two movable beams 16. The total of four pressing units 33 can be moved smoothly in the X-axis direction via guide rails 34 and linear bearings 35 provided on the upper surfaces of the movable beams 16. Each pressing unit 33 includes a movable bed 36 that is supported by the corresponding linear bearing 35 and that is substantially L-shaped when viewed in the Y-axis direction, and is constituted by mounting a servomotor 37 (actuator), an elevating unit 38, a shaft-like lower pressing rod 39 and a shaft-like upper pressing rod 40 that extend in the Z-axis direction, and a load cell 41 (load detecting means) on the movable bed 36. The load cell 41 can be moved smoothly in the z-axis direction via a guide rail 43 and a linear bearing 44 provided on a vertical wall of the movable bed 36. The lower pressing rod 39 and the upper pressing rod 40 are coaxially connected to each other with the load cell 41 interposed therebetween, and the lower pressing rod 39 extends through the elevating unit 38 in the Z-axis direction.

The elevating unit 38 is, for example, a jackscrew. A rotation shaft of the servomotor 37 extends in the X-axis direction so as to axially extend into the elevating unit 38 from a side surface thereof. The rotation of the servomotor 37 is changed in direction by 90 degrees by a gear (not shown) inside the elevating unit 38 and is converted into Z-axis motion of the lower pressing rod 39. Therefore, when the servomotor 37 operates, the lower pressing rod 39, the load cell 41, and the upper pressing rod 40 slide together in the Z-axis direction. The servomotor 37 is connected to the control unit 6 by a control line S4 (see FIG. 2) so as to be controlled by the control unit 6. The distal end of the upper pressing rod 40 serves as the aforementioned pressing point 40*a*.

Furthermore, as shown in FIG. 2, each pressing unit 33 has disposed therein a linear scale 45 (advance-retract-position detecting means) that detects the position of the pressing point 40*a* in the Z-axis direction (i.e., the advance-retract position of the upper pressing rod 40). The linear scale 45 is connected to the control unit 6 via a control line S5, and the advance-retract-position data of the pressing point 40*a* detected by the linear scale 45 is input to the control unit 6. Furthermore, the load cell 41 detects the load applied to the pressing point 40*a*. The load cell 41 is connected to the control unit 6 via a control line S6, and the load data detected by the load cell 41 is input to the control unit 6.

As described above, the support units 23 can move in the Y-axis direction along the slits 15*b* in the upper crossbeams 15. Moreover, since the pressing units 33 can move in the X-axis direction along the movable beams 16, and the movable beams 16 can also move in the Y-axis direction, the pressing units 33 can move in both the X-axis direction and the Y-axis direction. Therefore, the support points 25*a* and the pressing points 40*a* are movable independently in the planar direction of the plate-like workpiece W.

Furthermore, the support points 25*a* and the pressing points 40*a* can all be made to independently advance and retract in the Z-axis direction by the support units 23 and the pressing units 33 serving as advance-retract driving means. Such control is entirely performed by the control unit 6.

Furthermore, as shown in FIGS. 2 to 4, the aforementioned reaction-force absorbing devices 7 are provided at opposite surfaces, which extend in the Y-axis direction, of the twisting and retaining apparatus 1. Each pair of support columns 14 neighboring each other in the Y-axis direction is individually provided with roller support stays 48 that are slidable in the Z-axis direction by respective roller elevating mechanisms 49 (see FIG. 4). A workpiece support roller 50 extending in the Y-axis direction is rotatably supported between these roller support stays 48. The roller support stays 48 and the workpiece support roller 50 are biased from below by springs 51. By using height adjustment handles 52 and a height adjustment shaft 53 together with the springs 51, the roller elevating mechanisms 49 located at the opposite sides for supporting each workpiece support roller 50 can be manually raised or lowered in the Z-axis direction simultaneously for both sides. In FIG. 3, the roller elevating mechanisms 49 are illustrated in a simplified form.

The plate-like workpiece W, prior to being twisted or curved, is supported from below by these two workpiece support rollers 50, and the workpiece support rollers 50 serving as rolling members can transport the plate-like workpiece W in planar directions (in this case, the X-axis direction). The biasing strength of the springs 51 is set such that the springs 51 can support the weight of the plate-like workpiece W and can also absorb the reaction force applied as a result of flexing of the plate-like workpiece W when the plate-like workpiece W is twisted or curved.

Next, a processing procedure when the plate-like workpiece W is to be twisted and deformed by using the twisting and retaining apparatus 1 having the above-described configuration will be described with reference to FIGS. 6 and 7.

Figure 6:
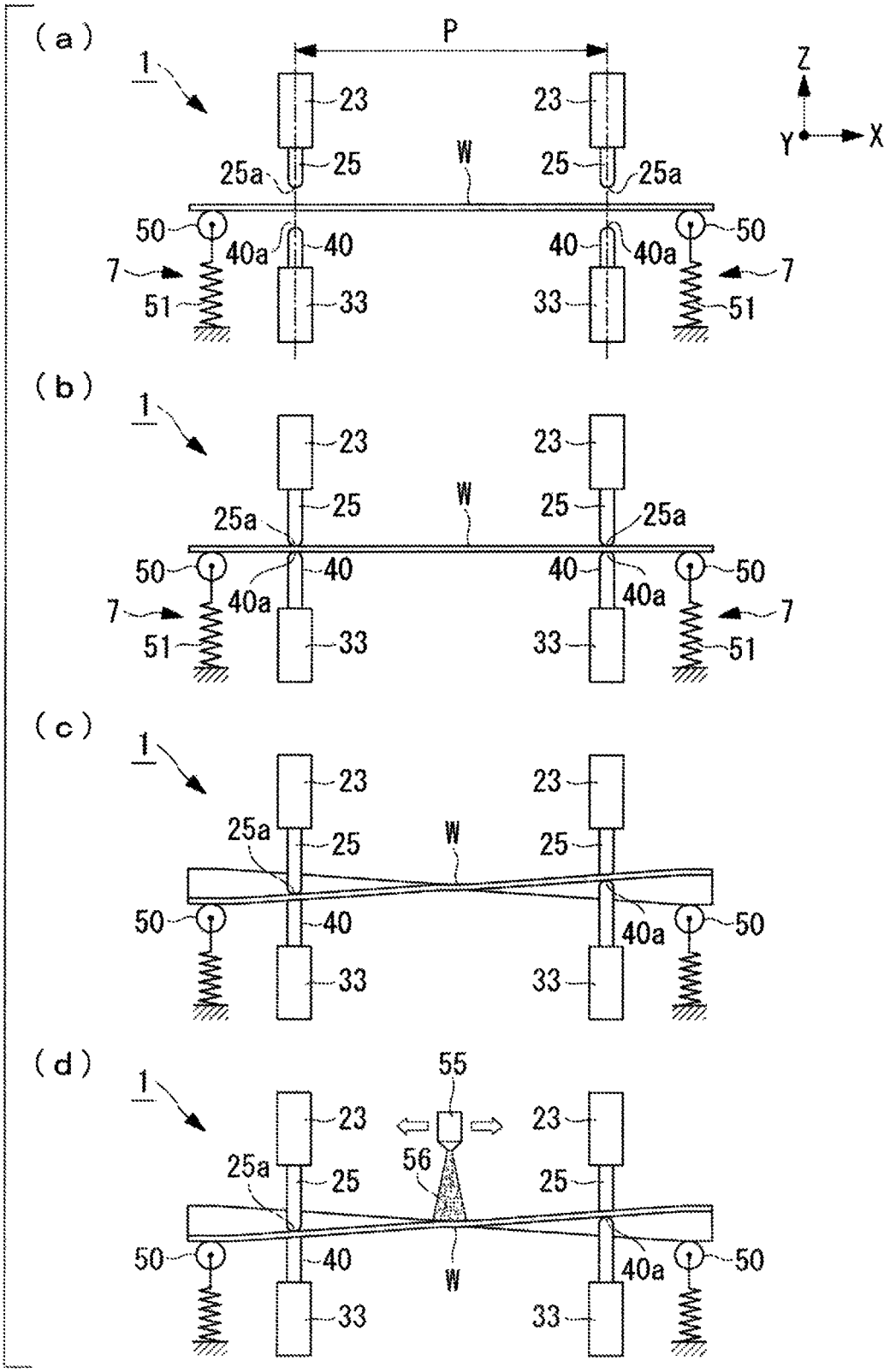
FIG. 6 illustrates an operation procedure of the twisting and retaining apparatus, where (a) shows a state where a plate-like workpiece is placed on workpiece support rollers, (b) shows a state where two support points and two pressing points are respectively in contact with diagonal positions on upper and lower surfaces of the plate-like workpiece, (c) shows a state where the plate-like workpiece is twisted and deformed by the support points and the pressing points, and (d) shows a state where shot peen forming is being performed.
Figure 7:
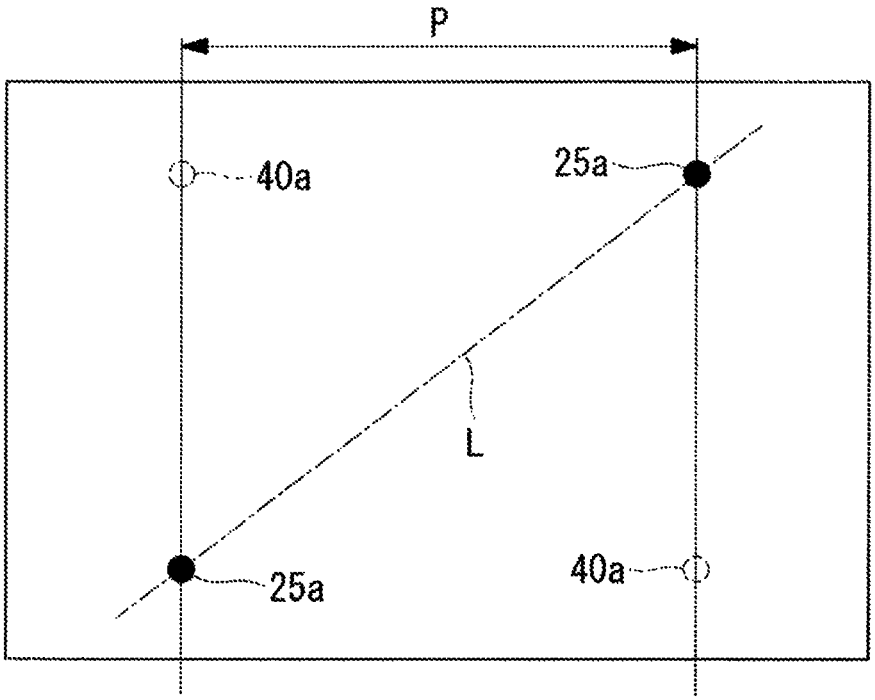
FIG. 7 is a plan view illustrating an example of contact positions of the support points and the pressing points relative to the plate-like workpiece.

First, as shown in FIG. 6(*a*), the plate-like workpiece W is placed on the workpiece support rollers 50. In this state, the support rods 25 (support points 25*a*) of the support units 23 and the upper pressing rods 40 (pressing points 40*a*) of the pressing units 33 are not in contact with the plate-like workpiece W. Therefore, the weight of the plate-like workpiece W is supported by the workpiece support rollers 50. The height of the plate-like workpiece W can be adjusted in the Z-axis direction by the height adjustment handles 52 (see FIG. 4) of the roller elevating mechanisms 49.

Subsequently, as shown in FIGS. 6(*b*) and 7, the support rods 25 of the support units 23 are lowered until, for example, two of the support points 25*a* come into contact with diagonal positions on the upper surface in the twisting range P of the plate-like workpiece W. This operation is performed by the control unit 6 controlling the servomotors 27 of the support units 23. The two support rods 25 are not necessarily lowered to the same height.

Likewise, the upper pressing rods 40 of the pressing units 33 are raised until two of the pressing points 40*a* come into contact with positions flanking a line L (see FIG. 7) connecting the two support points 25*a* on the lower surface in the twisting range P of the plate-like workpiece W. For example, in this case, the two pressing points 40*a* are in contact with positions where they form a rectangle in plan view together with the two support points 25*a*. This operation is performed by the control unit 6 controlling the servomotors 37 of the pressing units 33. The two upper pressing rods 40 are not necessarily raised to the same height.

Furthermore, as shown in FIG. 6(*c*), the support rods 25 are lowered so that the two support points 25*a* press downward against the corresponding diagonal positions of the plate-like workpiece W by a predetermined amount, and the upper pressing rods 40 are raised so that the two pressing points 40*a* press upward against the corresponding diagonal positions of the plate-like workpiece W by a predetermined amount. Alternatively, the upper pressing rods 40 alone may be raised higher without lowering the support points 25*a*. Consequently, the plate-like workpiece W is retained in a state where the twisting range P thereof is twisted and deformed. The twisting amount in this case is set within an elastically deformable range of the plate-like workpiece W.

When the plate-like workpiece W becomes twisted in this manner, one of the opposite ends of the plate-like workpiece W descends so that a reaction force is applied to the corresponding workpiece support roller 50. However, since the biasing strength of the springs 51 for the workpiece support roller 50 is set such that the springs 51 can absorb the reaction force from this plate-like workpiece W, the workpiece support roller 50 that has received the reaction force descends.

Then, in the state where the plate-like workpiece W is twisted and retained, the plate-like workpiece W is blasted with shot 56 from, for example, a peen forming device 55, as shown in FIG. 6(*d*). When blasting the plate-like workpiece W with the shot 56 after the plate-like workpiece W is preliminarily twisted and retained within its elastically deformable range, elastic stress applied to the plate-like workpiece W accelerates the deformation of the plate-like workpiece W, thereby significantly enhancing the shapeability of the plate-like workpiece W.

The control unit 6 controls the twisting and retaining apparatus 1 based on, for example, the following two methods.

First Method: The advance-retract-position data of the support points 25*a* and the pressing points 40*a* are input from the linear scales 29 and 45, and the servomotors 27 and 37 are driven so that the support points 25*a* and the pressing points 40*a* are set at predetermined advance-retract positions, thereby curving and retaining the plate-like workpiece W.

Second Method: The load data applied to the pressing points 40*a* are input from the load cells 41, and the servomotors 37 are driven so that predetermined loads are applied, thereby curving and retaining the plate-like workpiece W. This control may be performed together with the control according to the first method. Furthermore, the load cells 41 may be provided at the support point 25*a* side.

In the case of the control according to the first method, the control can be performed so that the relative distances between the support points 25*a* and the pressing points 40*a* are set to appropriate values, whereby the plate-like workpiece W can be given a relatively accurate twisted shape.

In the case of the control according to the second method, for example, if the plate-like workpiece W is to be plastically deformed by performing a peen forming process thereon while the plate-like workpiece W is retained in a twisted state, as described above, the peened plate-like workpiece W can be given an accurate twisted shape by a simple configuration.

Specifically, regardless of the relative relationship between the height at the four corners of the twisting range P before the twisting process and the height of the support points 25*a*, the support points 25*a* only need to be given a function for stopping at that height and maintaining that position when coming into contact with the plate-like workpiece W. Then, the pressing points 40*a* are pressed toward the plate-like workpiece W while the loads applied on the pressing points 40*a* from the load cells 41 are detected, whereby the plate-like workpiece W can be given accurate torsional curvature. Accordingly, since the height of the support points 25*a* does not need to be controlled, the linear scales 29 can be omitted, and the control unit 6 may have a lower level of performance. Furthermore, the servomotors 27 can be replaced with, for example, inexpensive air motors, thereby allowing for a simple and inexpensive apparatus configuration.

In order to curve the plate-like workpiece W without twisting it, four support points 25*a* are brought into contact with the four corners of the upper surface of the twisting range P, and two to four pressing points 40*a* are brought into contact with the lower surface of the twisting range P at a shorter span in the X-direction than the support points 25*a* and are pressed upward. In this case, the control according to the first method and the control according to the second method may be similarly applied.

When the curving process is performed, the plate-like workpiece W is curved into an upwardly bulging shape. Therefore, the plate-like workpiece W may be curved by acquiring the curvature data thereof using the curvature measuring device 8, inputting this curvature data to the control unit 6, and driving the servomotors 37 so that a predetermined curvature is obtained. Furthermore, this control may be performed together with the control according to the first method and the control according to the second method. Accordingly, since the relative position between the support points 25*a* and the pressing points 40*a* is set while measuring the actual curvature of the plate-like workpiece W, accurate curvature can be achieved.

In a case where peen forming is to be performed by blasting the workpiece W with the shot 56 from the peen forming device 55 while twisting the plate-like workpiece W, as described above, the control unit 6 may simultaneously control the peen forming device 55 and monitor the load data input from the load cells 41 during the peen forming process. When the load data stop decreasing or reach predetermined load values, the control unit 6 may perform control to stop the blasting with the shot 56.

In the case where the control is performed as described above, the reaction force that causes the plate-like workpiece W to recover its flat shape decreases as the peen forming process for blasting the twisted and retained plate-like workpiece W with the shot 56 proceeds, and the load data input to the control unit 6 from the load cells 41 decrease. Thus, it can be determined that the twisting process of the plate-like workpiece W is completed when the load data stop decreasing or reach predetermined load values, so that the peen forming process can be terminated. Therefore, the time spent for the peen forming process can be minimized, thereby shortening the processing time, as well as saving labor.

Accordingly, the twisting and retaining apparatus 1 includes at least the support points 25*a* that are contactable with a first surface (e.g., the upper surface) of the plate-like workpiece W, at least two pressing points 40*a* that are similarly contactable with a second surface (e.g., the lower surface) of the plate-like workpiece W and that flank the line L connecting the support points 25*a* in plan view of the plate-like workpiece W, the support units 23 that cause the support points 25*a* to advance toward and retract from the pressing points 40*a*, and the pressing units 33 that cause the pressing points 40*a* to advance toward and retract from the support points 25*a*.

Therefore, by interposing the plate-like workpiece W between the support points 25*a* and the pressing points 40*a* and reducing the relative distances between the pressing points 40*a* and the support points 25*a*, the plate-like workpiece W can be retained while being twisted and deformed by the support points 25*a* and the pressing points 40*a*.

The amount of deformation (i.e., the twisting amount) in this case can be arbitrarily set in accordance with, for example, the number of support points 25*a* and the number of pressing points 40*a*, the relative position between the support points 25*a* and the pressing points 40*a* in the planar directions (i.e., the X-direction and the Y-direction) of the plate-like workpiece W, and the pressing amounts (i.e., the pressing strokes and/or the pressing loads) of the support points 25*a* or the pressing points 40*a*. Therefore, the plate-like workpiece W can be given a freely-chosen twisted shape by a single twisting and retaining apparatus 1 regardless of, for example, the shape and size of the plate-like workpiece W or the intended twisted shape.

Consequently, the plate-like workpiece W can be twisted with a simple, highly-versatile configuration without having to prepare a die member, such as a press jig or a template, as in the related art. In addition, the support points 25*a* and the pressing points 40*a* come into point contact with the plate-like workpiece W. Thus, even the aircraft integral skin 4 obtained by combining the outer plate 2 with the rib-like reinforcement members 3, as shown in FIG. 1, can be readily twisted and deformed by bringing the support points 25*a* or the pressing points 40*a* into contact with areas other than the reinforcement members 3.

Furthermore, with respect to the planar direction of the plate-like workpiece W, the twisting and retaining apparatus 1 can independently move the support points 25*a* in the Y-axis direction and can independently move the pressing points 40*a* in the X-axis direction and the Y-axis direction.

Therefore, for example, by positionally moving any of the support points 25*a* and the pressing points 40*a* in the planar direction of the plate-like workpiece W, the twisted shape and the torsional curvature of the plate-like workpiece W can be set freely, thereby readily dealing with complicated twisted shapes.

In addition, in the case where multiple support points 25*a* and multiple pressing points 40*a* are provided and are all movable in the planar directions of the plate-like workpiece W, complex curved surfaces can also be readily dealt with. Moreover, the number of support points 25*a* and the number of pressing points 40*a* that are to be brought into contact with the plate-like workpiece W can be adjusted to numerical values suitable for the size of the plate-like workpiece W.

Furthermore, because the twisting and retaining apparatus 1 can cause all of the support points 25*a* and the pressing points 40*a* to independently advance and retract in the Z-axis direction by respectively using the support units 23 and the pressing units 33, the advance-retract positions (i.e., protruding amounts) of the multiple support points 25*a* and the multiple pressing points 40*a* relative to the plate-like workpiece W can be varied. Consequently, the plate-like workpiece W can be readily curved to and retained in a complicated twisted shape or a complex curved surface.

Furthermore, the twisting and retaining apparatus 1 includes three or more support points 25*a* and three or more pressing points 40*a*, and at least one of the points is contactable with a location other than the diagonal positions in the twisting range P of the plate-like workpiece W.

Figure 8:
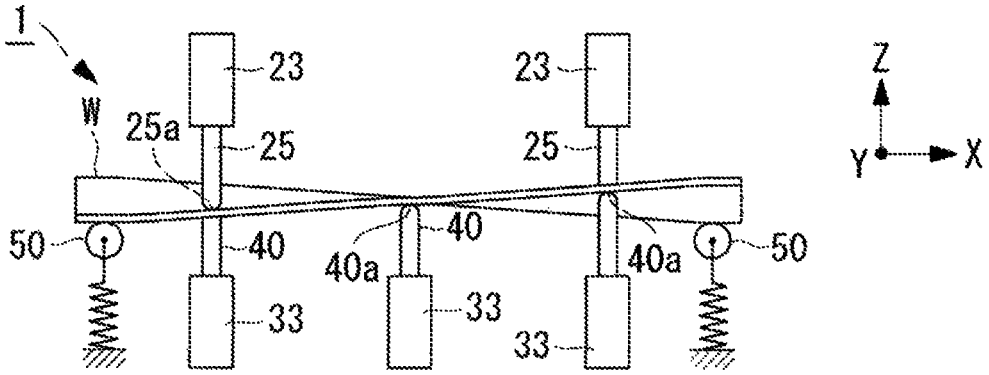
FIG. 8 is a side view illustrating a state where the plate-like workpiece is being bent while being twisted.

Therefore, in addition to twisting the twisting range P by pressing the support points 25*a* and the pressing points 40*a* onto the diagonal positions in the twisting range P of the plate-like workpiece W, as described above, for example, another pressing point 40*a* (or support point 25*a*) may be pressed onto an intermediate point of the twisting range P, as shown in FIG. 8, thereby bending the plate-like workpiece W while twisting it or preventing an intermediate section of the plate-like workpiece W from sagging downward due to its own weight.

Furthermore, the twisting and retaining apparatus 1 has the linear scales 29 and 45 (advance-retract-position detecting means) that detect the advance-retract positions of the support points 25*a* and the pressing points 40*a*, and the control unit 6 (control means) that receives the advance-retract-position data from the linear scales 29 and 45 and that drives the support units 23 and the pressing units 33 (advance-retract driving means) so that the support points 25*a* and the pressing points 40*a* are set at predetermined advance-retract positions.

Therefore, control can be performed so that the relative distances between the support points 25*a* and the pressing points 40*a* are set to appropriate values, whereby the plate-like workpiece W can be given a relatively accurate twisted shape.

Furthermore, the twisting and retaining apparatus 1 includes the load cells 41 (load detecting means) that detect the loads applied to the pressing points 40*a*. The load data from the load cells 41 are input to the control unit 6, and the control unit 6 drives the support units 23 and the pressing units 33 so that predetermined loads are applied to the load cells 41.

Therefore, by performing a peen forming process on the plate-like workpiece W while retaining the plate-like workpiece W in a twisted state, as described above, with an extremely simple configuration, the plate-like workpiece W can be given an accurate twisted shape. Specifically, regardless of the relative relationship between the height of the plate-like workpiece W before being twisted and deformed and the height of the support points 25*a*, the support points 25*a* only need to have a function for stopping at that height and maintaining that position when coming into contact with the plate-like workpiece W. Then, the plate-like workpiece W can be twisted and deformed by moving only the pressing points 40*a* toward the plate-like workpiece W while the loads applied onto the pressing points 40*a* from the load cells 41 are detected.

Furthermore, in a case where stress peen forming is to be performed by blasting the plate-like workpiece W with the shot 56 while twisting the plate-like workpiece W, the twisting and retaining apparatus 1 can perform control to stop the blasting with the shot 56 when the load data input to the control unit 6 from the load cells 41 stop decreasing or reach predetermined load values.

Therefore, it can be determined that the twisting process of the plate-like workpiece W is completed when the load data from the load cells 41 stop decreasing or reach predetermined load values during stress peen forming, so that the peen forming process can be terminated. Therefore, the time spent for the peen forming process can be minimized, thereby shortening the processing time, as well as saving labor.

The present invention is not limited to the configuration of the above embodiment. Appropriate modifications and alterations may be added so long as they do not depart from the scope of the present invention. Embodiments with such modifications and alterations added thereto are also included in the scope of the present invention.

For example, in the above embodiment, the support points 25*a* come into contact with the upper surface of the plate-like workpiece W, and the pressing points 40*a* come into contact with the lower surface. Alternatively, the up-down relationship between the support points 25*a* and the pressing points 40*a* may be inverted.

Furthermore, in the above embodiment, the workpiece support rollers 50 are used as workpiece support members. As an alternative to rollers, spherical or caster-type workpiece support members may be used. Thus, the plate-like workpiece W can be moved not only in the X-axis direction but also in the Y-axis direction, as well as other directions.

Furthermore, in the above embodiment, peen forming is performed by blasting only one surface of the plate-like workpiece W with the shot 56 while twisting the plate-like workpiece W. Alternatively, the opposite surfaces of the plate-like workpiece W may be simultaneously blasted with the shot 56.

Furthermore, as an alternative to performing peen forming by blasting with the shot 56, ultrasonic peen forming or laser peen forming may be performed.

REFERENCE SIGNS LIST

1 twisting and retaining apparatus
4 integral skin
6 control unit (control means)
7 reaction-force absorbing device
8 curvature measuring device
23 support unit (advance-retract driving means)
25 support rod
25*a* support point
27, 37 servomotor
28 ball screw mechanism
29, 45 linear scale (advance-retract-position detecting means)
33 pressing unit (advance-retract driving means)
40 upper pressing rod
40*a* pressing point
41 load cell (load detecting means)
50 workpiece support roller
51 spring
L line connecting two support points
P twisting range
W plate-like workpiece

The invention claimed is:

1. A plate-workpiece twisting and retaining apparatus for retaining a plate-workpiece while twisting the plate-workpiece, comprising:

at least two support rods that are contactable with a first surface of the plate-workpiece at a distal end thereof;

at least two pressing rods that are contactable with a second surface of the plate-workpiece at a distal end thereof and that flank a line connecting the distal ends of the at least two support rods in a plan view of the plate-workpiece; and an advance-retract driving unit that causes at least one of the support rods and the pressing rods to advance and retract in a thickness direction of the plate-workpiece, wherein at least one of the two support rods and the two pressing rods is independently movable in a planar direction of a surface, the surface being perpendicular to the thickness direction, of the plate-workpiece.

2. The plate-workpiece twisting and retaining apparatus according to claim 1, wherein the advance-retract driving unit is provided so as to be capable of causing all of the support rods and the pressing rods to independently advance and retract.

3. The plate-workpiece twisting and retaining apparatus according to claim 1, wherein the support rods include three or more support rods and the pressing rods include three or more pressing rods, and wherein at least one of the three or more support rods and the three or more pressing rods is contactable with a location other than contact positions of the two support rods and the two pressing rods necessary for twisting the plate-workpiece.

4. The plate-workpiece twisting and retaining apparatus according to claim 1, further comprising:

an advance-retract-position detecting unit that detects an advance-retract position of each of the support rods and the pressing rods; and a control unit that receives advance-retract-position data from the advance-retract-position detecting unit and drives the advance-retract driving unit so that the support rods and the pressing rods are set at predetermined advance-retract positions.

5. The plate-workpiece twisting and retaining apparatus according to claim 1, further comprising:

a load detecting unit that detects loads applied to the pressing rods; and a control unit that receives load data from the load detecting unit and drives the advance-retract driving unit so that predetermined loads are applied.

6. The plate-workpiece twisting and retaining apparatus according to claim 5, wherein when peen forming is performed while twisting the plate-workpiece, as the peen forming proceeds, the control unit performs control to stop the peen forming being performed when the load data received from the load detecting unit stop decreasing or reach predetermined load values.

7. A plate-workpiece twisting and retaining method for retaining a plate-workpiece while twisting the plate-workpiece, comprising:

bringing at least two support rods into contact with a first surface of the plate-workpiece at a distal end thereof;

bringing at least two pressing rods into contact with a second surface of the plate-workpiece at a distal end thereof such that the at least two pressing rods flank a line connecting the distal ends of the at least two support rods in a plan view of the plate-workpiece; and twisting and retaining the plate-workpiece by pressing at least one of the support rods and the pressing rods in a thickness direction of the plate-workpiece, wherein at least one of the two support rods and the two pressing rods is independently movable in a planar direction of a surface, the surface being perpendicular to the thickness direction, of the plate-workpiece.

8. A plate-workpiece twisting and shaping method comprising:

twisting and shaping a plate-workpiece by performing peen forming from at least one surface of the plate-workpiece while retaining the plate-workpiece in a twisted state by using the plate-workpiece and retaining apparatus according to claim 1.

9. The plate-workpiece twisting and shaping method according to claim 8, wherein the plate-workpiece and retaining apparatus further comprises a load detecting unit that detects loads applied to the pressing rods, and wherein, when the plate-workpiece and retaining apparatus performs peen forming while twisting the plate-workpiece, as the peen forming proceeds, the plate-workpiece and retaining apparatus performs control to stop the peen forming being performed when the load data received from the load detecting unit stop decreasing or reach predetermined load values, and when peen forming is performed while twisting the plate-workpiece, as the peen forming proceeds, the peen forming being performed is controlled to be stopped when the load data received from the load detecting unit stop decreasing or reach predetermined load values.

* * * * *